US009873855B2

(12) United States Patent
Koehneke

(10) Patent No.: US 9,873,855 B2
(45) Date of Patent: Jan. 23, 2018

(54) CLEANING FORMULATIONS AND USES THEREOF

(71) Applicant: Hydrapak, Inc., Oakland, CA (US)

(72) Inventor: Justin Koehneke, Huntington, VT (US)

(73) Assignee: Hydrapak, Inc., Oakland, CA (US)

( * ) Notice: Subject to any disclaimer, the term of this patent is extended or adjusted under 35 U.S.C. 154(b) by 832 days.

(21) Appl. No.: 14/018,663

(22) Filed: Sep. 5, 2013

(65) Prior Publication Data

US 2014/0000658 A1 Jan. 2, 2014

Related U.S. Application Data

(63) Continuation-in-part of application No. PCT/US2012/027875, filed on Mar. 6, 2012.

(60) Provisional application No. 61/781,258, filed on Mar. 14, 2013, provisional application No. 61/449,979, filed on Mar. 7, 2011.

(51) Int. Cl.

| | |
|---|---|
| ***C11D 3/39*** | (2006.01) |
| ***C11D 1/825*** | (2006.01) |
| ***C11D 1/37*** | (2006.01) |

(52) U.S. Cl.

CPC ..... *C11D 1/8255* (2013.01); *C11D 1/37* (2013.01)

(58) Field of Classification Search

CPC ..... C11D 3/3942

See application file for complete search history.

(56) References Cited

U.S. PATENT DOCUMENTS

| | | | | |
|---|---|---|---|---|
| 2002/0058605 | A1 | 5/2002 | Schmidt et al. | |
| 2002/0160929 | A1 | 10/2002 | Singh et al. | |
| 2005/0043199 | A1 | 2/2005 | Franzolin et al. | |
| 2005/0119153 | A1 | 6/2005 | Burt et al. | |
| 2007/0179076 | A1 | 8/2007 | Gibson et al. | |
| 2010/0197558 | A1 * | 8/2010 | Miralles | C11D 3/044 510/488 |

FOREIGN PATENT DOCUMENTS

| | | |
|---|---|---|
| WO | WO 2012/122166 | 9/2012 |

* cited by examiner

*Primary Examiner* — Gregory E Webb

(74) *Attorney, Agent, or Firm* — Levine Bagade Han LLP

(57) ABSTRACT

Cleaning compositions and methods of using such compositions. The compositions comprise oxidizing agent(s); weak acid(s), and surfactant(s) (e.g., a combination of short-chain non-ionic surfactant(s) and long-chain non-ionic surfactant (s) or a combination of short-chain anionic surfactant(s) and long-chain anionic surfactant(s)). The compositions can be used to clean objects such as reusable water containers, home seltzer-maker bottles, hydration bladders, coffee mugs, etc.

20 Claims, No Drawings

CLEANING FORMULATIONS AND USES THEREOF

CROSS-REFERENCE TO RELATED APPLICATIONS

This application is a continuation-in-part of PCT/US12/27875, filed Mar. 6, 2012, which claims priority to U.S. provisional patent application No. 61/449,979, filed Mar. 7, 2011, the disclosures of which are incorporated herein by reference. This application also claims priority to U.S. provisional patent application No. 61/781,258, filed Mar. 14, 2013, the disclosure of which is incorporated herein by reference.

FIELD OF THE DISCLOSURE

This disclosure generally relates to cleaning formulations comprising combinations of surfactants. More particularly, the disclosure relates to formulations comprising combinations of non-ionic or anionic surfactants.

BACKGROUND OF THE DISCLOSURE

Use of reusable water bottles and hydration systems has become commonplace. Such bottles and systems provide a conducive environment for mold, bacteria and other contaminants, and can become stained and present unpleasant odors. Such bottles and systems can be difficult to clean effectively due to their design and fabrication materials.

BRIEF SUMMARY OF THE DISCLOSURE

The present disclosure provides cleaning compositions and methods of using such compositions. The compositions comprise building components (e.g., oxidizing agents and weak acids) and a surfactant component (e.g., combinations of surfactants). The compositions can be used in a wide variety of applications.

The methods of the present disclosure use the compositions to clean a wide variety of objects. For example, the compositions can be used to clean reusable water containers (such as personal-size water containers and jerry cans), home seltzer-maker bottles, hydration bladders, coffee mug, baby bottles, travel mugs, boat and RV water systems, humidifier systems, water coolers, brewery equipment, and coffee makers.

DETAILED DESCRIPTION OF THE DISCLOSURE

The present disclosure provides a composition, which can be used to clean, for example, reusable water bottles and hydration systems. The present disclosure also provides methods for cleaning. By "cleaning" it is meant the methods remove undesirable coloration/staining, odors, and/or residue(s) and/or disinfects the object of the methods (e.g., a container). By disinfects it is meant that contacting an object with the cleaning composition of the present disclosure decreases the number of undesirable microbes in or on the object (e.g., disinfection can reduce the amount of bacteria (i.e., the composition exhibits antibacterial behavior) and mold (i.e., the composition exhibits antimicrobial behavior)). For example, the methods of the present disclosure provide more effective at cleaning and disinfecting as compared to cleaning with common soap solutions. For example, the present disclosure provides a method for cleaning reusable water bottles and hydration systems. Based on the large numbers of bottles and systems in use, use of an environmentally-friendly cleaning system that avoids the use of harsh and toxic chemicals is desirable.

In an aspect, the present disclosure provides cleaning compositions. In an embodiment, the composition has builder components and surfactant components. The builder components include, for example, various oxidizing agents and various weak acids. In some examples, combinations of oxidizing agents are used. Surfactants such as, for example, non-ionic surfactants and anionic surfactants can be used.

For example, a combination of surfactants are used, such as a combination of a short-chain alcohol (a narrow range C8 alcohol plus 4 mols ethylene oxide) alkoxylate non-ionic surfactant (e.g., BEROL® 840 a alcohol ethoxylate non-ionic surfactant having a molecular weight of approximately 307 and a viscosity of 50 cps at 20° C., BEROL® 840 (not commonly used in hard surface cleaning), which is considered to provide wetting properties, limits foaming, and improves rinsing and a reverse ethylene oxide-propylene oxide (EO-PO) block polymer surfactant (e.g., PLURONIC® 17R4, a difunctional block copolymer surfactant with terminal secondary hydroxyl groups), which is considered to provide wetting properties, emulsification properties, and limits redeposition of suspended soils. Without intending to be bound by any particular theory, it is considered that the combination of such surfactants, e.g., BEROL® 840 and PLURONIC® 17R4 and Amisoft® HS-11P and Amisoft® LS-1, creates a synergy in action and cleaning effectiveness.

Also, it is desirable to have the pH level of the composition such that the cleaning composition exhibits desirable cleaning performance. In various embodiments, the cleaning compositions of the present disclosure can have a pH of from 7.5-10.0, including all ranges there between and values to the 0.1 pH unit. For example, the cleaning composition will have a pH in the range stated above when the composition is in the form of an aqueous solution.

The composition comprises builder materials at from 75 to 99.5% by weight, including all ranges and values therebetween. Builder materials include, for example, oxidizing agents and weak acids. The following are non-limiting examples of oxidizing agents. Sodium percarbonate is a white crystalline water-soluble adduct of sodium carbonate and hydrogen peroxide, with formula $Na_2CO_3 \cdot 1.5H_2O_2$. Sodium percarbonate is commonly known as oxygen based bleach. For example, sodium percarbonate can be present at from 15 to 55% by weight, including all ranges and values therebetween. Other examples of oxidizing agents include, but are not limited to, benzoic acid and sodium perborate.

The following are additional examples of builder materials. Sodium carbonate is a sodium salt of carbonic acid, with formula $Na_2CO_3$. Sodium carbonate is commonly referred to as washing soda. For example, sodium carbonate can be present at from 5 to 25% by weight, including all ranges and values therebetween. Sodium bicarbonate is a white solid that is crystalline but often appears as a fine powder with the formula $NaHCO_3$. Sodium bicarbonate is commonly known as baking soda. For example, sodium bicarbonate can be present at from 15 to 40% by weight, including all ranges and values therebetween. Other examples of builder materials include, but are not limited to, sodium borate, sodium gluconate, and sodium heptogluconate. In an embodiment, sodium carbonate is not used as a builder material.

In an embodiment, the composition further comprises a polymer dispersant. The polymer dispersant can be a homopolymer dispersant or copolymer dispersant. Without intending to be bound by any particular theory, it is considered that the dispersant increases dissolution of the composition (i.e., the composition exhibits decreased dissolution time) and enhances solubility of the composition in water. The a polymer dispersant can also act as a chelating agent and provide anti-scale forming properties. For example, the composition comprises dispersant at from 0.5 to 30% by weight, including all ranges and values therebetween. Examples of suitable polymer dispersants include ITACONIX® Dispersant DSP 2K polyitaconate, low molecular weight linear polyitaconic acid partially neutralized with sodium salt), Acusol™ 445/445N (homopolymer of acrylic acid with an average MW of 4500), Acusol™ 497N (acrylic/maleic copolymer with an average MW of 70,000), and Acusol™ 460N (carboxylated polyelectrolyte copolymer with an average MW of 10,000).

In an embodiment, a peracid is used as a builder material and the composition further comprises sodium nonanoyloxy benzene sulphonate (SNOBS) or tetra-acetyl ethylenediamine (TAED) or a combination thereof. It is considered that these components convert a free peroxide to a peracid, which is a stronger oxidizer and results in the composition providing desirable results at lower water temperatures than compositions without such components.

Examples of weak acids include, but are not limited to, citric acid, lactic acid, acetic acid, and uric acid. Without intending to be bound by any particular theory, it is considered that weak acids provide chelating and solubilizing of hard water minerals (e.g., $Ca^{2+}$ and $Mg^{2+}$). It is desirable, for example in the case of citric acid, the weak acid be neutralized such that it exists in the salt form. Additionally, it is desired that at least some portion of the acid decompose during use of the composition to form carbon dioxide.

The composition comprises non-ionic surfactants or anionic surfactants at from 0.01 to 4% by weight, including all ranges and values therebetween. Commercially available non-ionic surfactants can be used. For example, alcohol alkoxylate (e.g., alcohol ethoxylate surfactants), alkyl amine oxide, ethylene oxide/propylene oxide reverse block copolymer non-ionic surfactants, and combinations of such surfactants can be used. The following are non-limiting examples of non-ionic surfactants. BEROL® 840 and MACAT® AO-8 (octyl dimethylamine oxide, CAS#2605-78-9) are commercially available low-foaming narrow-range nonionic surfactants based on a synthetic alcohol. These surfactants are slightly water soluble materials that can function as a wetting agents, degreasers, and/or emulsifiers. For example, BEROL® 840 and/or MACAT® AO-8 can be present at from 0.25 to 2% by weight, including all ranges and values therebetween. Alfonic® 810-4.5 having the formula: $CH_3(CH_2)_xCH_2(OCH_2CH_2)_{4.5}OH$ where 'x' varies between 8 and 10, is a commercially available ethoxylated alcohol surfactant. PLURONIC® 17R2 (a difunctional block copolymer surfactant with terminal secondary hydroxyl groups), 17R4, 25R2 (a difunctional block copolymer surfactant with terminal secondary hydroxyl groups), and L62 LF (a difunctional block copolymer surfactant terminating in primary hydroxyl groups) are commercially available difunctional ethylene oxide/propylene oxide reverse block copolymer surfactants. Pluronic 17R4 is desirable because it is non-toxic and biodegradable. PLURONIC® 17R4 has an average molecular weight of 3100 and a viscosity of 680 cps at 25° C. PLURONIC® 25R2 has an average molecular weight of 3600 and a viscosity of 1110 cps at 25° C. These non-ionic surfactants are 100% active, nontoxic, and readily biodegradable. For example, PLURONIC® 17R4 and/or PLURONIC® 25R2 can be present at from 0.25 to 2% by weight, including all ranges and values therebetween.

In an embodiment, the short-chain nonionic surfactants are Alfonic® 810-4.5 (Sasol) or Berol 840® (Akzo). These short-chain non-ionic surfactants are combined with long-chain surfactants, such as Pluronic® series surfactants from BASF (e.g., Pluronic® 17R2, 25R2, and L62 LF).

In an embodiment, the non-ionic surfactants are a combination of a small molecule non-ionic surfactant (e.g., a short-chain non-ionic surfactant such as BEROL® 840 or MACAT® AO-8) and a large molecule non-ionic surfactant (e.g., a long-chain non-ionic surfactant such as PLURONIC® 17R4 or PLURONIC® 25R2). Without intending to be bound by any particular theory, it is considered that the small molecule surfactant migrates through solution more rapidly providing a rapid cleaning effect (e.g., observed faster wetting of the soils that results in rapid dissolution and subsequent suspension of soils). Also, large molecule surfactants are slower to equilibrate (e.g., long-chain surfactants such as PLURONIC® 17R4 engage in the formation of micellar structures and are slow to exit such structure) and as a result they are effective in maintaining the suspension of soils that have been freed from a soiled substrate and prevent the redeposition of those soils. Thus, the composition incorporating such surfactants provides emulsification capacity. For example, when the composition is drained from a surface, a desirable amount of the soil drains along with the solution. This synergistic combination of surfactants provides a composition that can exhibit desirable wetting, soil suspension, and/or cleaning effects.

In an embodiment, the surfactant is a combination of an alcohol alkoxylate (e.g., an alcohol ethoxylate) non-ionic surfactant having a molecular weight of from 150 to 450, including all integer values to the g/mol and ranges therebetween, or an alkyl amine oxide non-ionic surfactant having alkyl groups comprising from 1 to 10 carbons, including all integer carbon numbers and ranges therebetween, and an ethylene oxide/propylene oxide reverse block copolymer non-ionic surfactant having a molecular weight of from 1500 to 5000, including all integer values to the g/mol and ranges therebetween The surfactants can be anionic surfactants. In an embodiment, two anionic surfactants are used. The composition comprises anionic surfactants at from 0.01 to 4.0% by weight, including all ranges and values therebetween. It is desirable that the anionic surfactant(s) be low foaming anionic surfactant(s). Commercially available anionic surfactants can be used. The anionic surfactants can be naturally derived (e.g., algae derived). For example, surfactants created from amino acids, natural fatty acids, coconut fatty acids, and combinations thereof can be used. For example, Amisoft® HS-11P, Amisoft® LS-11, and combinations of such anionic surfactants can be used. These anionic surfactants are 100% active, nontoxic, and readily biodegradable.

In an embodiment, the anionic surfactants are a combination of a small molecule anionic surfactant (e.g., a short-chain anionic surfactant such as Amisoft® HS-11P (sodium stearoyl glutamate)) and a large molecule anionic surfactant (e.g., a long-chain anionic surfactant such as Amisoft® LS-11 (sodium lauroyl glutamate)). For example, Amisoft® HS-11P and/or Amisoft® LS-11 can be present at from 0.01 to 4.0% by weight, including all ranges and values therebetween. The combination of anionic surfactants offer the same synergistic effects observed in the non-ionic surfactant combination.

In an embodiment, the binder system comprises cellulose. For example, the cellulose is food grade cellulose.

In an embodiment, the composition is comprised of all natural ingredients, thus making the composition non-toxic, biodegradable, and 100% natural.

The cleaning composition can exhibit antimicrobial properties. Contact with the composition can reduce the concentration of undesirable microorganisms (e.g., bacteria and mold). For example, contact with a composition for 15 minutes can reduce the concentration of a bacteria (such as *Escherichia coli* or *Aspergillus niger*) or mold by at least 80%.

In embodiments, the composition of the present disclosure consists essentially of or consists of the building components and surfactant components. In this embodiment, the composition can, optionally, include water, binders, or fillers such as dendritic sodium chloride.

Without intending to be bound by any particular theory it is considered that the composition can provide a "super-effervescent" effect that provides desirable cleaning properties, and that the citric acid is neutralized in situ to produce at least some amount of sodium citrate, which chelates hard water minerals to improve performance of the cleaning product and to limit scale formation.

The cleaning composition can be in a liquid form (e.g., solution) or solid form (e.g., powder form and tablet form). In an embodiment, the composition is an aqueous solution. For example, the concentration of the composition in solution (e.g., a solution prepared prior to use or prepared by dissolving a tablet or power in water) can be from 0.2 to 2% by weight, including all values to 0.1% by weight and ranges therebetween. In an embodiment, the present disclosure provides a tablet comprising a cleaning composition of the present disclosure. The cleaning composition is combined with binder materials and other ingredients known in the art as necessary to arrive at a formulation that can be formed into a tablet. It is desirable that the binder materials and other ingredients not substantially affect the properties of the cleaning composition.

An example of a cleaning composition is given in Table 1. All component amounts herein are provided in weight percent of the composition.

TABLE 1

Example of a Cleaning Composition

| Component | Weight % |
|---|---|
| Sodium Percarbonate | 29.5 |
| Sodium Carbonate | 14.5 |
| Citric Acid | 29.6 |
| Sodium Bicarbonate | 24.6 |
| BEROL ® 840 | 0.9 |
| PLURONIC ® 17R4 | 0.9 |

An example of a cleaning composition which can be formed into a tablet is provided in Table 2.

TABLE 2

Example of cleaning formulation

| Component | Weight % |
|---|---|
| Sodium Percarbonate | 40 |
| Sodium Carbonate | 15 |
| Citric Acid Anhydrous | 15 |
| Sodium Bicarbonate | 12 |

TABLE 2-continued

Example of cleaning formulation

| Component | Weight % |
|---|---|
| Binder System | 16.6 |
| BEROL ® 840 | 0.7 |
| PLURONIC ® 17R4 | 0.7 |

In various embodiments, the composition is in tablet form and comprises the components in Tables 3 or 4.

TABLE 3

Example of cleaning formulation

| Component | Weight % |
|---|---|
| Sodium Percarbonate | 19.7 |
| Sodium Carbonate | 9.9 |
| Citric Acid Anhydrous | 19.0 |
| Sodium Bicarbonate | 35 |
| Binder System | 15 |
| BEROL ® 840 | 0.7 |
| PLURONIC ® 17R4 | 0.7 |

TABLE 4

Example of cleaning formulation

| Component | Weight % |
|---|---|
| Sodium Percarbonate | 38 |
| Sodium Carbonate | 15 |
| Citric Acid Anhydrous | 8 |
| Sodium Bicarbonate | 22 |
| Binder System | 15.6 |
| BEROL ® 840 | 0.7 |
| PLURONIC ® 17R4 | 0.7 |

In an embodiment, the cleaning composition has a powder form (e.g., comprising the components set out in Table 2, except that the binder is replaced by dendritic sodium chloride). In various embodiments, the cleaning composition comprises the components in Table 2 (except that the binder is replaced by dedritic sodium chloride) in ranges +/−10% of the weight % values provided, including all values to the 0.1 wt. % therebetween.

In various embodiments, the composition is in powder form and comprises the components in Tables 5 or 6.

TABLE 5

Example of a Cleaning Composition

| Component | Weight % |
|---|---|
| Sodium Percarbonate | 29.5 |
| Sodium Carbonate | 14.5 |
| Citric Acid | 29.6 |
| Sodium Bicarbonate | 24.6 |
| BEROL ® 840 | 0.9 |
| PLURONIC ® 17R4 | 0.9 |

TABLE 6

Example of a Cleaning Composition

| Component | Weight % |
|---|---|
| Sodium Percarbonate | 53.6 |

TABLE 6-continued

| Example of a Cleaning Composition | |
|---|---|
| Component | Weight % |
| Sodium Carbonate | 15 |
| Citric Acid | 8 |
| Sodium Bicarbonate | 22 |
| BEROL ® 840 | 0.7 |
| PLURONIC ® 17R4 | 0.7 |

An example of a cleaning composition which can be formed into a tablet is provided in Table 7.

TABLE 7

| Example of a 100% naturally derived Cleaning Composition | |
|---|---|
| Component | Weight % |
| Sodium Percarbonate | 47 |
| Binder System | 5 |
| Citric Acid | 18 |
| Sodium Bicarbonate | 24.95 |
| ITACONIX ® DSP 2K | 5 |
| Amisoft HS-11P | 0.04 |
| Amisoft LS-11 | 0.01 |

In various embodiments, the cleaning composition comprises the components in Tables 1-7 in ranges +/−10% of the weight % values provided, including all values to the 0.1 wt. % therebetween.

In an aspect, the present disclosure provides a method of cleaning using the cleaning compositions described herein. In various embodiments, containers (e.g., reusable water containers (such as personal-size water containers (such as water bottles) and jerry cans), home seltzer-maker bottles, hydration bladders, baby bottles, mugs (such as coffee mugs and travel mugs)), boat and recreational vehicle (RV) water systems, camping equipment (e.g., dishes), humidifier systems, mouth guards/dentures, coffee makers (including automatic coffee makers, espresso makers, single serve brewers (such as KEURIG®)), equipment for brewing wine and beer (both home and commercial use), indoor and outdoor water coolers/dispensers, and the like can be cleaned using the compositions of the present disclosure.

In an embodiment, the method for cleaning a container comprising the steps of: optionally, fully or partially filling the container with water; adding a cleaning composition to the container, where the cleaning composition is a composition of present disclosure; optionally, sealing the container, where, optionally, the container is allowed to stand; mixing the contents of the container; optionally, allowing container to stand; optionally, mixing contents of container (e.g. by shaking) at intervals to moisten interior surfaces; removing the cleaning solution; and optionally, rinsing the container. In an embodiment, the mixture is allowed to stand for 1 minute to 24 hours, including all ranges and values to the minute therebetween.

In an embodiment, the present disclosure provides a method for cleaning a water bottle (e.g., a reusable water bottle) comprising the steps of: a) adding a desired amount of water to the bottle; b) adding the cleaning composition (e.g., in solid or solution form); c) allowing bottle with composition to stand (e.g., for 5 minutes); d) capping the bottle securely and mixing (e.g., by shaking bottle); e) partially loosening the cap, f) shaking to wet screw threads; g) allowing bottle and composition to stand (e.g., for 10 minutes); h) removing cleaning solution; and i) rinsing bottle and cap with water. In various embodiments, steps a), d), e), f), g) and i) are each independently optional.

In an embodiment, the present disclosure provides a method for cleaning water containers such as, for example, hydration bladders and hoses. In an embodiment, the present disclosure comprises the steps of: a) partially filling the water container (e.g., filling a hydration bladder ½ full with water), b) adding the cleaning composition (e.g., in solid or liquid form); c) sealing the container and allowing container to stand (e.g., for 5 minutes); d) mixing (e.g., by shaking the container); e) in the case of a water bladder, squeezing the bite valve and compressing to remove air, and filling the hose; f) allowing container to stand (e.g., for 10 minutes); g) removing (e.g., draining) the cleaning solution; and h) rinsing the container (in the case of a water bladder, including rising the hose). In various embodiments, steps a), d), e), f), and h) are each independently optional.

In the methods, the container can be partially or completely filled with any temperature water. While hot (e.g., 105° F.-140° F.), warm (e.g., 80° F.-104° F.) or cold water (e.g., 40° F.-79° F.) can be used in the methods, it is considered that hot water reduces the standing time necessary.

In an embodiment, the compositions of the present disclosure can be used in cleaning methods without a rinsing step after removal of the cleaning solution. In such no-rinse methods, the object of the method can be used without rinsing the object to remove any residual composition, if any.

In the method, longer mixing and standing times may be appropriate. For example, if a tablet form of the cleaning composition is used (which may require time to dissolve) or if heavy soiling is being cleaned, longer mixing and standing times may be used.

The present disclosure is advantageous for at least the following reasons:

- Provides fast cleaning—can work in 5 minutes or less;
- Provides effective cleaning—removes stains, odors, and microbes; and
- The composition is considered to be safe—e.g., it is non-toxic and readily biodegradable.

Example 1

The builder components are the base and make up the bulk of the ingredients. After numerous trials of different component percentages a desirable combination of components was identified. After further trials on various surfactant components, a blend of two surfactants that appeared to have a synergistic effect was identified as desirable. Also, the pH of the composition was adjusted to achieve desirable levels of reactivity and performance. The surfactant combination had enhanced function when used together—creating a fizzing, micro-foaming action that appeared to be churning at the surface. The resulting cleaning composition was tested on various types of soils that were created by aging common drinks such as milk, juice, and sports drinks. It was found that the surfactants accelerated the cleaning and clearly helped to lift particulate soils from the surfaces. The formula turned out to have desirable cleaning performance and effectively removed odors and stains from soiled bottles and hydration systems. For example, cleaning formulations were made by adding a 1.5 gram tablet cleaning composition or 2 tablespoons of a powder cleaning composition for each liter of water used to clean a container.

Testing of the cleaning compositions has shown desirable results. The compositions have effectively cleaned various surfaces and the cleaned surfaces exhibit a fresh scent. Various soils such as, for example, liquids including milk, juice, coffee, and sports drinks have been tested. Various materials including, for example, stainless steel, aluminum, glass, and various types of plastic have been tested.

Example 2

The following is an example of antimicrobial behavior of a composition of the present disclosure. This study was performed according to the ASTM E 2315 Time Kill Test (PA 19428-2959, ASTM E 2315-03). The testing was performed at ACCUGEN LABORATORIES, INC, 50 West 75th Street, Willowbrook, Ill. 60527.

Test Conditions:

Challenge Organisms: *Escherichia coli* ATCC#8739
*Aspergillus niger* ATCC#16404
Neutralizer used: Dey Engley (DE) neutralizing broth
Contact time: 5 min, 15 min, 30 min
Contact temperature: 35° C.
Negative Control: Phosphate Buffer
Media and reagents:
Tryptic Soy broth
Tryptic Soy agar
DE neutralizing broth
Sabouraud Dextrose agar
Sterile Deionized Water TEST METHOD. The test material was brought into contact with a known population of microorganisms for a specified period of time at a specified temperature. Activity of the test material was quenched by neutralizing broth and surviving microorganisms were enumerated. The percent reduction was calculated from initial microorganisms and surviving microorganisms data.

Results.

| Exposure | Concentration of Organism (CFU/mL) *Escherichia coli* ATCC# 8739 | | % Reduction | |
|---|---|---|---|---|
| Time | Control | Product | Control | Product |
| Initial | 5000 | — | — | — |
| 5 min | 5000 | $2.7 \times 10^3$ | ≤0 | 46.00% |
| 15 min | 5000 | $5.9 \times 10^2$ | ≤0 | 88.20% |
| 30 min | 5000 | 0 | ≤0 | ≥99.99% |

| Exposure | Concentration of Organism (CFU/mL) *Aspergillus niger* ATCC# 16404 | | % Reduction | |
|---|---|---|---|---|
| Time | Control | Product | Control | Product |
| Initial | 5000 | — | — | — |
| 5 min | 5000 | 900 | ≤0 | 82.00% |
| 15 min | 5000 | 800 | ≤0 | 84.20% |
| 30 min | 5000 | 20 | ≤0 | 99.60% |

$$\% \text{ Reduction} = \frac{\text{Initial Count} - \text{Count at} \times \text{time interval}}{\text{Initial Count}} \times 100$$

CONCLUSION

Sample showed 46.00% antimicrobial activity at 5 minutes, 88.20% antimicrobial activity at 15 minutes, and ≥99.99% antimicrobial activity at 30 minutes of exposure against *Escherichia coli* while sample showed 82.00% antimicrobial activity at 5 minutes, 84.00% antimicrobial activity at 15 minutes, and 99.60% antimicrobial activity at 30 minutes of exposure against *Aspergilus niger.*

While the disclosure has been particularly shown and described with reference to specific embodiments (some of which are preferred embodiments), it should be understood by those having skill in the art that various changes in form and detail may be made therein without departing from the spirit and scope of the present disclosure as disclosed herein.

What is claimed is:

1. A composition comprising:
an oxidizing agent;
sodium carbonate, sodium bicarbonate, or a combination thereof;
a weak acid;
surfactants comprising:
sodium stearoyl glutamate, and
sodium lauroyl glutamate;
a binder; and
a polymer dispersant.

2. The composition of claim 1, wherein the weak acid is citric acid.

3. The composition of claim 1, wherein the oxidizing agent is present in the composition at 15 to 55 weight percent.

4. The composition of claim 1, wherein the weak acid is present in the composition at 5 to 35 weight percent.

5. The composition of claim 1, wherein the surfactants are present in the composition at 0.01 to 4 weight percent.

6. The composition of claim 1, wherein the composition is in tablet form.

7. The composition of claim 1, wherein the oxidizing agent is sodium percarbonate constituting about 29.5% by weight of the composition, wherein the weak acid is citric acid constituting about 18% by weight of the composition, wherein the polymer dispersant constitutes about 5% by weight of the composition, wherein the sodium stearoyl glutamate constitutes about 0.04% by weight of the composition, wherein the sodium lauroyl glutamate constitutes about 0.01% by weight of the composition, wherein the binder is cellulose constituting about 5% by weight of the composition, and wherein the polymer dispersant is sodium polyitaconate constituting about 5% by weight of the composition, and wherein the composition has a pH of between 7.5 to 10.

8. The composition of claim 1, wherein the polymer dispersant is sodium polyitaconate.

9. The composition of claim 8, wherein the polymer dispersant is present at 0.5 to 30 weight percent.

10. The composition of claim 1, wherein the composition has a weight ratio of about 4:1 of the first anionic surfactant to the second anionic surfactant.

11. A composition, comprising:
an oxidizing agent constituting about 47% by weight of the composition;
at least one of sodium carbonate and sodium bicarbonate constituting about 24.95% by weight of the composition;
a weak acid constituting about 18% by weight of the composition;
a first anionic surfactant constituting about 0.04% by weight of the composition;
a second anionic surfactant constituting about 0.01% by weight of the composition;
a binder constituting about 5% by weight of the composition; and
a polymer dispersant constituting about 5% by weight of the composition.

12. The composition of claim 11, wherein the first anionic surfactant is sodium stearoyl glutamate and the second anionic surfactant is sodium lauroyl glutamate.

13. The composition of claim 11, wherein the binder is cellulose.

14. The composition of claim 11, wherein the oxidizing agent is sodium percarbonate, wherein the weak acid is citric acid, wherein the first anionic surfactant is sodium stearoyl glutamate and the second anionic surfactant is sodium lauroyl glutamate, wherein the binder is cellulose, and wherein the polymer dispersant is polyitaconic acid partially neutralized with sodium salt.

15. The composition of claim 11, wherein the oxidizing agent is at least one of sodium percarbonate, benzoic acid, and sodium perborate.

16. A composition, comprising:

an oxidizing agent, wherein the oxidizing agent is between 45% to 50% by weight of the composition;

sodium bicarbonate, wherein the sodium bicarbonate is between 20% to 30% by weight of the composition;

a weak acid, wherein the weak acid is between 15% to 20% by weight of the composition;

a first anionic surfactant, wherein the first anionic surfactant is between 0.01% to 0.05% by weight of the composition;

a second anionic surfactant, wherein the second anionic surfactant is between 0.01% to 0.03% by weight of the composition;

a binder; and a polymer dispersant.

17. The composition of claim 16, wherein the first anionic surfactant is sodium stearoyl glutamate constituting about 0.04% by weight of the composition and the second anionic surfactant is sodium lauroyl glutamate constituting about 0.01% by weight of the composition, wherein the weak acid is citric acid, wherein the binder is cellulose constituting about 5% by weight of the composition, wherein the polymer dispersant is polyitaconic acid partially neutralized with sodium salt constituting about 5% by weight of the composition.

18. The composition of claim 16, wherein the binder is about 5% by weight of the composition.

19. The composition of claim 16, wherein the first anionic surfactant is sodium stearoyl glutamate and the second anionic surfactant is sodium lauroyl glutamate.

20. The composition of claim 16, wherein the polymer dispersant is about 5% by weight of the composition.

* * * * *